US006019456A

United States Patent [19]

Onishi et al.

[11] Patent Number: 6,019,456

[45] Date of Patent: Feb. 1, 2000

[54] LIQUID JET RECORDER

[75] Inventors: Kazunori Onishi; Masashi Hiratsuka; Naoki Morita, all of Ebina, Japan

[73] Assignee: Fuji Xerox Co., Ltd., Tokyo, Japan

[21] Appl. No.: 08/938,970

[22] Filed: Sep. 26, 1997

[30] Foreign Application Priority Data

Oct. 1, 1996 [JP] Japan ..... 8-260475

[51] Int. Cl.[7] ..... B41J 2/05; B41J 2/165

[52] U.S. Cl. ..... 347/57; 347/22; 347/26

[58] Field of Search ..... 347/10, 11, 22, 347/26, 56, 57

[56] References Cited

U.S. PATENT DOCUMENTS 5,638,100 6/1997 Kanematsu et al. .

FOREIGN PATENT DOCUMENTS 63-141754 6/1988 Japan .

6-122198 5/1994 Japan .

7-17040 1/1995 Japan .

8-90790 4/1996 Japan .

*Primary Examiner*—Matthew S. Smith

*Attorney, Agent, or Firm*—Oliff & Berridge, PLC

[57] ABSTRACT

To remove deposit on a protective film 6 of heating resistors 3, main pulse P3r of multi-pulse drive is set to the width narrower than main pulse width P3s at the normal recording time and wider than the main pulse width starting film boiling in a region on the protective film including heating regions of the heating resistors, and the heating resistors 3 are driven, whereby the deposit is peeled in a wide area including the heating region. After bubbles grow in an ink chamber 9, they shrink and disappear as the heating resistors 3 terminate heating. Liquid rapidly flows into the ink chamber 9 accordingly, and the deposit on the protective film can be removed by cavitation at the time.

5 Claims, 6 Drawing Sheets

FIG.3A
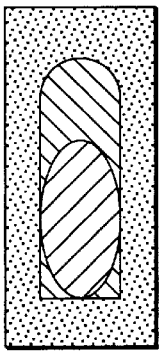
FIG.3B
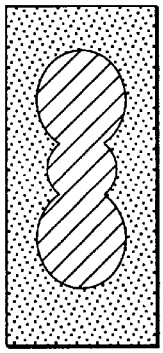
FIG.3C
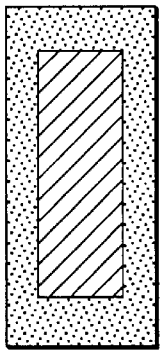
FIG.4
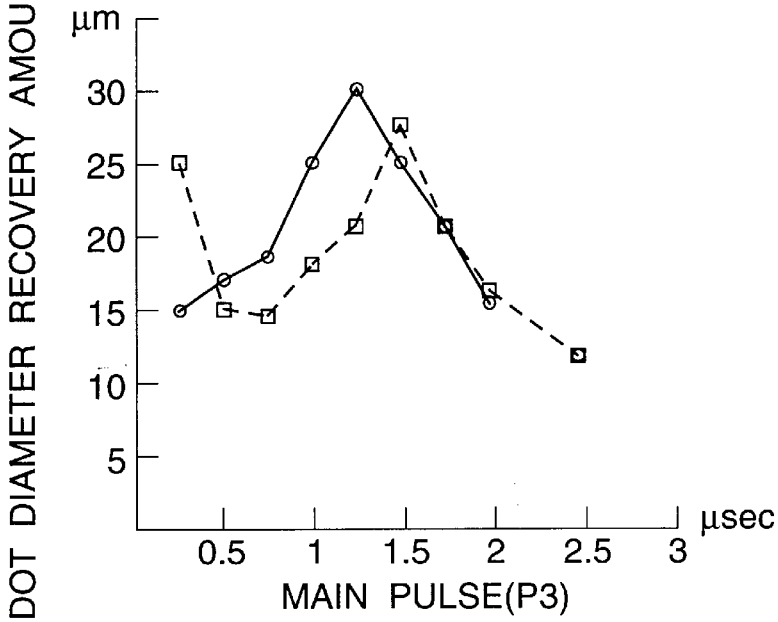
FIG.5
| | P3R (μsec) | NUMBER OF PULSES | |
|---|---|---|---|
| | | WHENEVER 1-PAGE RECORDING TERMINATES | WHENEVER INK TANK IS REPLACED |
| RECOVERY PULSE 1 | 1.250 | 100 | 5000 |
| DUMMY JET | 2.000 | 30 | 30 |

FIG.6
| | P3R (μsec) | NUMBER OF PULSES | | JET HISTORY |
|---|---|---|---|---|
| | | WHENEVER 1-PAGE RECORDING TERMINATES | WHENEVER INK TANK IS REPLACED | |
| RECOVERY PULSE 1 | 1.250 | 100 | 5000 | UP TO $3\times10^8$ PULSES |
| RECOVERY PULSE 2 | 1.500 | 100 | 5000 | $3\times10^8$ PULSES OR MORE |
| DUMMY JET | 2.000 | 30 | 30 | |
FIG.7
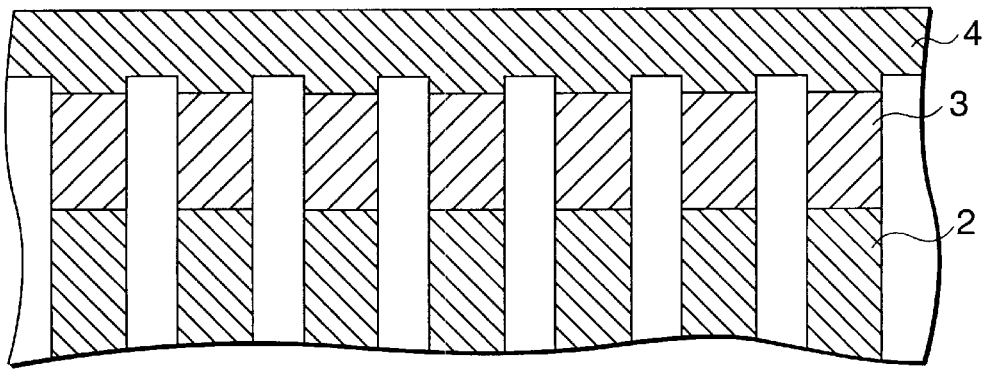
FIG.8
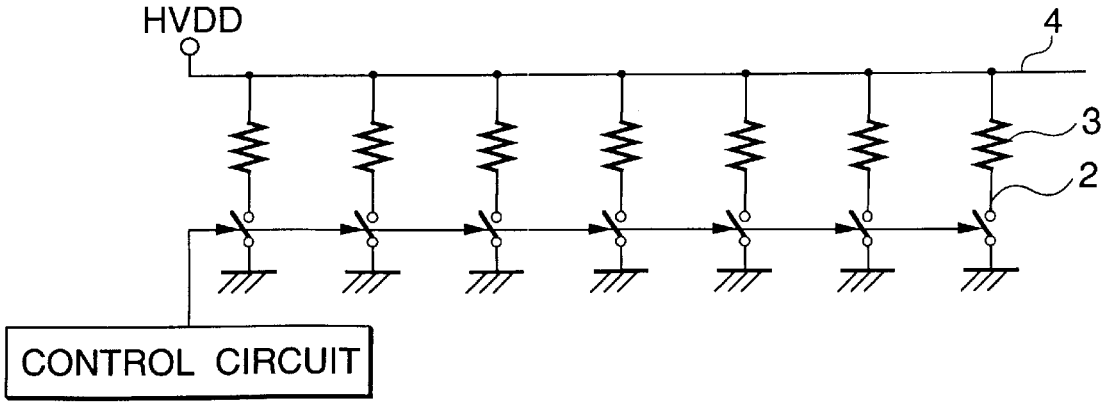

LIQUID JET RECORDER

BACKGROUND OF THE INVENTION

This invention relates to a liquid jet recorder for jetting a liquid for forming field liquid drops for recording.

A recorder using heat energy is available as one of liquid jet recorders for jetting a liquid for recording. This thermal liquid jet recorder using heat energy is in the limelight as a recorder which provides high image quality and can execute high-speed recording although it is manufactured at low cost. In the thermal liquid jet recorder, a heating resistor is energized for converting electric energy into heat energy, which then is transmitted to a liquid for film boiling of the liquid and the liquid is jetted by pressure at the growth time of produced bubbles. At this time, as the heating resistor generates heat, a substance consisting essentially of carbon adheres onto a protective film of the heating resistor from the liquid and a film consisting essentially of carbon is deposited on the protective film because of long-term use. This film hinders transmission of heat energy produced from the heating resistor to the liquid, lowering energy efficiency, weakening the liquid jet force, thus causing degradation of the image quality.

On the other hand, a single pulse drive method and a multi-pulse drive method are available as main drive methods of the thermal liquid jet recorders. FIGS. 2A and 2B are illustration of examples of the thermal liquid jet recorder drive methods. The single pulse drive is a drive method for giving one pulse to a heating resistor as shown in FIG. 2A. Formerly, the single pulse drive was used; the multi-pulse drive as shown in FIG. 2B is used as a stabler drive method and becomes mainstream at present. The multi-pulse drive is a drive method for giving multiple pulses for driving a thermal liquid jet recorder. In the example shown in FIG. 2B, first energy is given on pulse P1, called prepulse P1, to the extent that it does not jet a liquid, and the liquid is warmed. After a lapse of pause period P2, energy for jetting the liquid is given on pulse P3, called main pulse P3, for flying liquid drops. However, if the multi-pulse drive is executed, a film consisting essentially of carbon remains deposited on a protective film; the above-described problem is unsolved.

A measure against the problem that a film consisting essentially of carbon is deposited on a protective film of a heating resistor is described, for example, in the Unexamined Japanese Patent Application Publication No. Hei 6-122198, wherein an impact (cavitation) force of ink concentrating on bubble removal points when bubbles are removed is raised by raising ink temperature and lowering ink viscosity for improving the inertia force at the refilling time with ink, by executing multi-pulse drive for warming ink for increasing the number of molecules changing in state from liquid phase to vapor phase, or by halving the drive voltage for increasing the number of phase conversion molecules for peeling off and removing the film of carbon, etc., on the protective film of the heating resistor. Removal of deposit by cavitation is also described in the Unexamined Japanese Patent Application Publication No. Hei 7-17040.

FIGS. 3A to 3C are illustration of state examples on a protective film of a heating resistor after removal of deposit. In the figure, the hatching density denotes the deposit degree; the higher the density, the more the deposit. FIG. 3C shows the state on a protective film of a heating resistor after removal of deposit according to the invention described later; it is desired to remove the deposit as shown here.

According to the method as described in the document, the deposit can be removed on the periphery of the bubble disappearance point as shown in FIG. 3A. However, the area of the deposit that can be removed is not the whole protective film and is only the periphery of the bubble disappearance point; the deposit at points away from the bubble disappearance point cannot completely be removed, as shown in FIG. 3A.

A method of removing the deposit in the area that cannot be removed is described, for example, in the Unexamined Japanese Patent Application Publication No. Hei 8-90790, wherein at least one of prepulse P1 and pause pulse P2 is modulated two steps or more for changing the bubble removal (disappearance) point position. However, the position is not sufficiently changed and deposit remains as shown in FIG. 3B.

SUMMARY OF THE INVENTION

It is therefore an object of the invention to provide a liquid jet recorder which enables efficient removal of deposit on a protective film of heating resistors.

According to the invention of aspect 1, there is provided a liquid jet recorder comprising nozzles for jetting a liquid, heating resistors being provided in a one-to-one correspondence with the nozzles for receiving electric energy, generating heat energy to jet a liquid, and jetting a liquid from the nozzles, a protective film for protecting the heating resistors, and control means for controlling the electric energy given to the heating resistors, characterized in that the control means executes multi-pulse drive consisting of prepulses not jetting a liquid to the heating resistors and main pulses jetting a liquid to the heating resistors, sets each main pulse to the width narrower than the main pulse width at the normal recording time and wider than the main pulse width starting film boiling in a region on the protective film including heating regions of the heating resistors, and causes the nozzles to jet a liquid for removing deposit adhering onto the protective film.

In the invention of aspect 2, in the liquid jet recorder of aspect 1, the control means executes dummy jet for jetting a liquid as at the normal recording time after removing the deposit.

In the invention of aspect 3, in the liquid jet recorder of aspect 1, the control means selectively uses the main pulse width for removing the deposit from within two or more main pulse widths.

According to the invention of aspect 4, there is provided a liquid jet recorder comprising nozzles for jetting a liquid, heating resistors being provided in a one-to-one correspondence with the nozzles for receiving electric energy, generating heat energy to jet a liquid, and jetting a liquid from the nozzles, a protective film for protecting the heating resistors, and control means for controlling the electric energy given to the heating resistors, characterized in that the control means changes the number of the heating resistors for jetting a liquid at the same time and drives the heating resistors for removing deposit adhering onto the protective film.

According to the invention of aspect 5, there is provided a liquid jet recorder comprising nozzles for jetting a liquid, heating resistors being provided in a one-to-one correspondence with the nozzles for receiving electric energy, generating heat energy to jet a liquid, and jetting a liquid from the nozzles, a protective film for protecting the heating resistors, and control means for controlling the electric energy given to the heating resistors, characterized in that the control means controls the electric energy given to the heating resistors according to a predetermined pattern comprising a portion where the heating resistors jet a liquid and a portion where the heating resistors do not jet a liquid in proper combination for removing deposit adhering onto the protective film.

BRIEF DESCRIPTION OF THE DRAWINGS

In the accompanying drawings:

FIGS. 3A to 3C are illustration of state examples on a protective film of a heating resistor after removal of deposit;

FIG. 4 is a graph to show the relationship between main pulse P3 and dot diameter recovery amount;

FIG. 5 is an illustration of a specific example of deposit removal pulse condition;

FIG. 6 is an illustration of another specific example of deposit removal pulse condition;

FIG. 7 is an illustration of a wiring pattern example;

FIG. 8 is a circuit diagram to show an equivalent circuit to the wiring pattern;

DETAILED DESCRIPTION OF THE PREFERRED EMBODIMENTS

Figure 1:
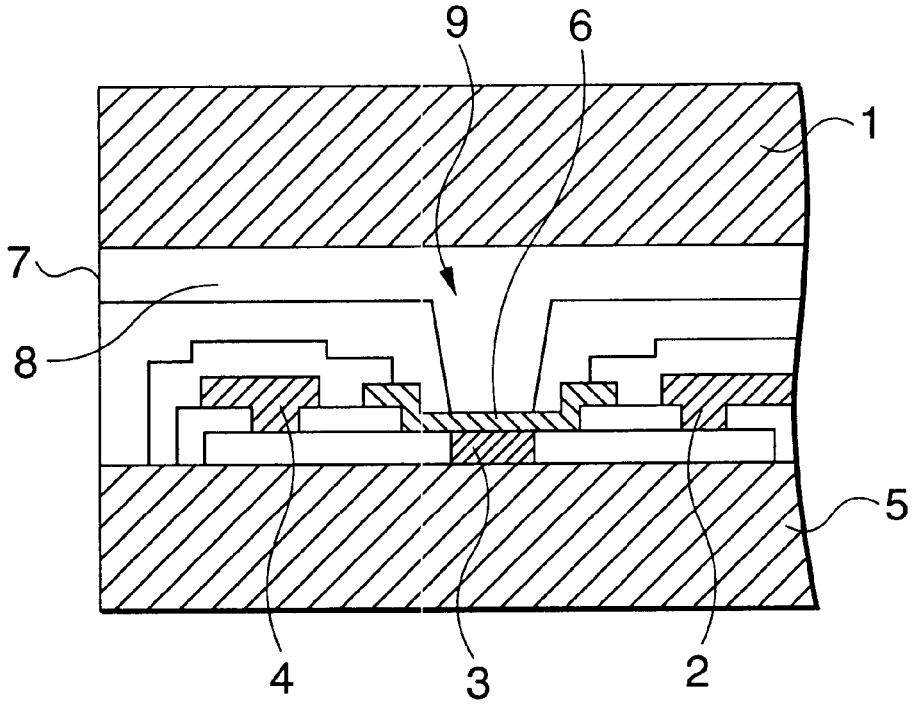
FIG. 1 is a schematic sectional view to show an example of a head portion in one embodiment of a liquid jet recorder of the invention.

FIG. 1 is a schematic sectional view to show an example of a head portion in one embodiment of a liquid jet recorder of the invention. In the figure, numeral 1 is a flow passage substrate, numeral 2 is a driver electrode, numeral 3 is a heating resistor, numeral 4 is a common electrode, numeral 5 is a support substrate, numeral 6 is a protective film, numeral 7 is a spout hole, numeral 8 is a flow passage, and numeral 9 is an ink chamber. A heating resistor layer is formed on the support substrate 5 and is doped with impurities as required for forming a heating region as the heating resistor 3. An interlayer insulating film is formed on the heating resistor 3, then the driver electrode 2 and the common electrode 4 are formed for electric connection to the heating resistor 3 via contact holes, etc., for example. The protective film 6 is formed on the heating resistor 3 for protecting the heating resistor from chemical damage caused by contact with a liquid such as ink and physical damage of cavitation, etc. Resin layers are applied except for the heating region on the heating resistor 3. Here, two resin layers are provided, but only one layer may be sufficient. The portion on the heating resistor 3 wherein the resin layers are not formed becomes the ink chamber 9.

In another process, the flow passage 8 corresponding to the heating resistor 3, a common liquid chamber (not shown), and the like are formed on the flow passage substrate 1 and are joined or bonded to the support substrate 5 formed as described above, thereby manufacturing a head. The driver electrode 2 and the common electrode 4 are connected to a drive circuit, etc., for example, formed on the support substrate 5, and the head is attached to a main unit and is electrically connected to a controller in the main unit.

When a drive signal is applied from the drive circuit, etc., to the heating resistor 3 via the driver electrode 2 and the common electrode 4, the heating resistor 3 converts electric energy into heat energy and emits heat into a liquid. The emitted heat causes bubbles to be produced in the liquid. The produced bubbles grow in the ink chamber 9 and the liquids in the ink chamber 9 and the flow passage 8 are jetted through the spout hole 7 by the pressure at the time. The jetted liquid drops are field to and adhere onto a recording medium for recording.

After the liquid drops are jetted, quick cooling is performed as the electric energy is cut off, and the bubbles shrink. A liquid is again supplied from the ink tank (not shown) to the flow passage 8 by the negative pressure at the time. The bubbles disappear on the protective film 6. When the bubbles disappear, the liquid rapidly flows into the bubble disappearance point, causing cavitation to occur. The protective film 6 protects the heating resistor 3 from the cavitation.

Heat emitted into the liquid in the process causes impurities, dyes, etc., in the liquid to become carbonized, adhere onto the protective film 6, and be deposited thereon gradually. The energy efficiency lowers because of the deposit and the field liquid drop volume decreases, causing the concentration to lower. Thus, the deposit is removed at any time other than the normal recording time, such as maintenance time. The deposit removal operation will be discussed. To drive the heating resistor 3, the multi-pulse drive as shown in FIG. 2B is executed.

Figure 2A:
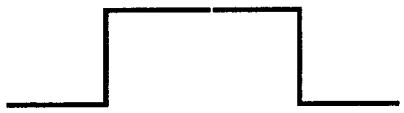
FIGS. 2A and 2B are illustration of examples of thermal liquid jet recorder drive methods.
Figure 2B:
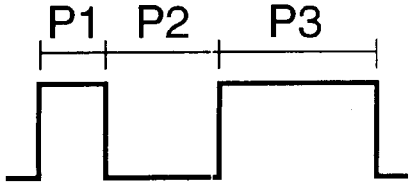

For example, in the multi-pulse drive signal shown in FIG. 2B, the prepulse P1 and pause time P2 are fixed and the main pulse P3 is changed for removing the deposit. FIG. 4 is a graph to show the relationship between the main pulse P3 and the dot diameter recovery amount. Here, the prepulse P1 and the pause time P2 are fixed to 0.750 $\mu$sec and 4.000 $\mu$sec respectively, the application time of the main pulse P3 is changed, and the dot diameter recovery amount at the time is shown. The dot diameter recovery amount indicates the deposit removal degree. The solid line denotes an experiment example for a new head and the broken line means an experiment example for a head jetting $3\times10^8$ pulses.

If the measurement conditions is supplementally described, the new head is a head applying $5\times10^5$ pulses, and the dot diameter at this time is about 70 $\mu$m.

When $3\times10^8$ pulses are applied, the dot diameter is about 70 $\mu$m.

Dot diameter recovery amount="dot diameter measurement value B"−"dot diameter measurement value A"

The dot diameter at the normal operation is 100 $\mu$m.

Print pulses are the same as dummy jet pulses.

As seen in the graph shown in FIG. 4, the optimum condition of the main pulse P3 for maximizing the dot diameter recovery amount exists; in the example of the new head, the dot diameter recovery amount reaches a maximum value when the main pulse P3 is 1.250 $\mu$sec. After $3\times10^8$ pulses are jetted, oxidization of the protective film develops and the heat transfer rate lowers. Resultantly, the optimum condition of the main pulse P3 also changes; when the main pulse P3 is 1.500 $\mu$sec, the dot diameter recovery amount reaches a maximum value.

If the main pulse P3 is short, stable film boiling does not occur in the region on the protective film 6 including the heating region. If the main pulse P3 is too long, overheat occurs and the deposit removal efficiency lowers. The above-described optimum value is a condition for starting film boiling in the region on the protective film 6 including the heating region. At this time, the deposit is peeled in a wide range including the heating region. The deposit can be removed efficiently because of cavitation caused by the subsequent bubble disappearance. Further, idle spouting called dummy jet normally executed at the maintenance time is performed consecutively, whereby the deposit peeled off in the flow passage can be spouted off to the outside.

If the deposit removal operation is performed under the above-described optimum value condition, the maximum effect can be produced. In fact, assuming that the application time of the main pulse P3 at the recording time is P3s, P3r may satisfy the relation 0.750 μsec≦P3r<P3s.

Such deposit removal operation generally may be performed when the maintenance operation is performed; for example, it may be performed periodically after 1-page recording terminates, when the ink tank is replaced, etc. It may also be performed irregularly when an error occurs, etc. The number of times a main pulse P3r to remove deposit is applied may be set experimentally. FIG. 5 is an illustration of a specific example of deposit removal pulse condition. Here, P3r is set to 1.250 μsec and is called recovery pulse 1. Each time 1-page recording terminates, 100 recovery pulses 1 are applied, then dummy jet is executed as many as 30 pulses. Each time the ink tank is replaced, 5000 recovery pulses 1 are applied, then dummy jet is executed as many as 30 pulses.

FIG. 6 is an illustration of another specific example of deposit removal pulse condition. Here, the different optimum values of the main pulses P3 for a new head and a head after $3\times10^8$ pulse recording are listed based on the graph shown in FIG. 4. The number of jet times is stored as a jet history. If the jet history is up to $3\times10^8$ pulses, P3r is set to 1.250 μsec; if the jet history is $3\times10^8$ pulses or more, P3r is set to 1.500 μsec, which is called recovery pulse 2. The number of pulses is similar to that in the specific example shown in FIG. 5. Each time 1-page recording terminates, 100 recovery pulses 1 or 2 and 30 dummy jet pulses are applied in response to the jet history. Each time the ink tank is replaced, 5000 recovery pulses 1 or 2 and 30 dummy jet pulses are applied in response to the jet history.

The divided pulse is shown as follows.

| | | | | Number of pulses | |
|---|---|---|---|---|---|
| Step | Prepulse width | Pause time | Main pulse width P3r | Whenever 1-page recording terminates | Whenever ink tank is replaced |
| Recovery pulse 1 | 0.75 | 4.00 | 1.25 | 100 | 5000 |
| Recovery pulse 2 | 0.75 | 4.00 | 1.50 | 100 | 5000 |

The deposit removal operation is performed according to the setting as shown in FIG. 5 or 6, whereby the deposit can be removed efficiently as shown in FIG. 3C.

Figure 11:
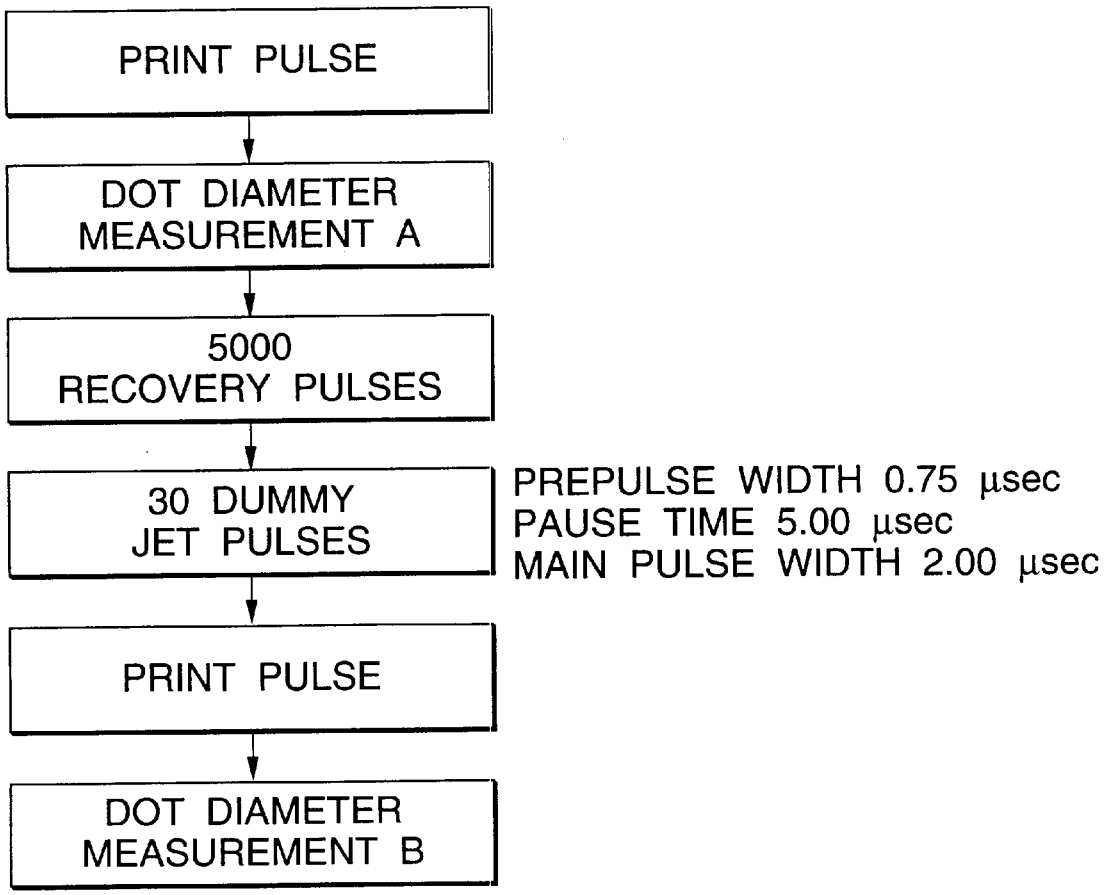
FIG. 11 shows dot diameter recovery amount measurement conditions.

Additionally, in FIG. 11, the dot diameter recovery amount measurement conditions in the case of a replacement of the ink tank are specified. A print pulse is emitted(A) and a dot diameter measurement A is made(B). Then, 5000 recovery pulses are executed(C) followed by 30 dummy pulses(D) wherein the prepulse width is 0.75 μsec, the pause time is 5 μsec and the main pulse width is 2.00 μsec (E). After this another print pulse is conducted(F) and another dot diameter measurement B is conducted in G.

Film boiling can also be started in the region on the protective film 6 including the heating region, for example, by changing drive voltage as well as the application time of the main pulse P3 described above. However, changing the drive voltage is not practical because the power supply is upsized, etc. As an alternative method, a technique of changing the number of nozzles jetting at the same time and using a voltage drop at the common electrode can be used.

FIG. 7 is an illustration of a wiring pattern example. FIG. 8 is a circuit diagram to show an equivalent circuit to the wiring pattern. As also shown in FIG. 1, the heating resistor 3 is connected at one end to the driver electrode 2 and at the other end to the common electrode 4. As shown in FIG. 7, a plurality of heating resistors 3 are connected to the common electrode 4 in parallel and a supply voltage is supplied. In the equivalent circuit as shown in FIG. 8, resistors are connected to the common electrode 4 in parallel. Switching elements corresponding to the heating resistors 3 are turned on/off by a drive signal, for example, as shown in FIG. 2B from a control circuit, whereby the corresponding heating resistors 3 are driven. If the number of the driven heating resistors 3 is large, the whole resistance value decreases and a large current flows; a voltage drop occurs due to power supply capacity, resistance of the common electrode 4, etc. The voltage drop is used to change the number of the heating resistors 3 to be driven, whereby the supply voltage supplied to each heating resistor can be changed.

Figure 9A:
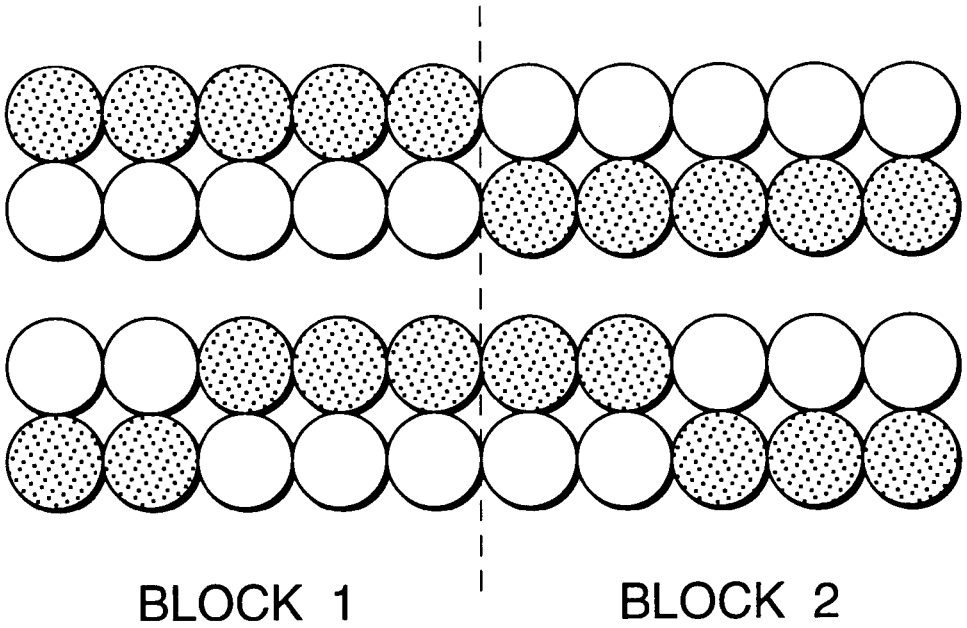
FIGS. 9A and 9B are illustration of change pattern examples of nozzles jetting at the same time.
Figure 9B:
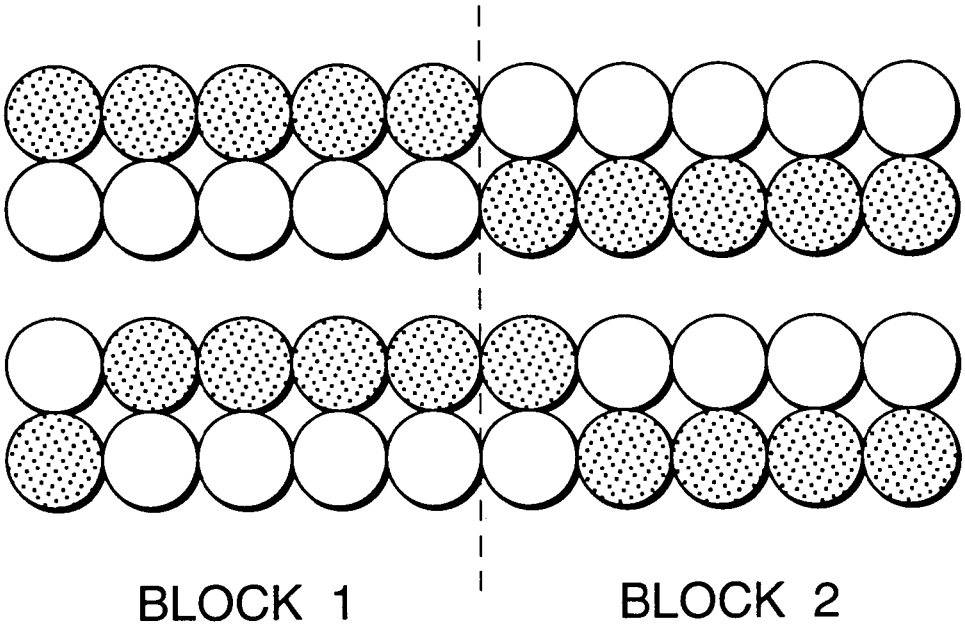

FIGS. 9A and 9B are illustration of change pattern examples of nozzles jetting at the same time. In the figure, 0 denotes a nozzle not jetting a liquid and denotes a nozzle jetting a liquid. In the examples shown in FIGS. 9A and 9B, five nozzles can be driven at the same time and a group of the nozzles that can be driven at the same time is called a block. The blocks are not driven at the same time and are driven at different timings. Here, only two blocks are shown.

In the example shown in FIG. 9A, a pattern of driving all five nozzles in the block and a pattern of driving three or two nozzles are switched for use. For the pattern of driving five nozzles, the drive voltage becomes the lowest and when three or two nozzles are driven, the voltage becomes higher than the drive voltage. In the example shown in FIG. 9B, a pattern of driving all five nozzles in the block and a pattern of driving one or four nozzles are switched for use. For the pattern of driving five nozzles, the drive voltage becomes the lowest due to a voltage drop and when one nozzle is driven, the voltage becomes almost the supply voltage. The position at which only one nozzle is driven is shifted in order, whereby the deposit on the nozzle can be removed. The patterns shown in FIGS. 9A and 9B may be combined to produce another available pattern.

The number of driven nozzles is thus changed for changing the voltage, whereby the nozzles can be made to jet a liquid under a condition close to the condition for starting film boiling on the protective film 6 including the heating region, so that the deposit can be removed.

If the nozzles are driven according to the pattern as shown in FIGS. 9A and 9B, a liquid flow occurs via a common liquid chamber between the nozzles spouting a liquid and those not spouting a liquid. This liquid flow is not so furious as resupply of a liquid to each nozzle and is a moderate flow, but can well peel the deposit likely to be peeled by cavitation and remove the deposit.

As described above, removal of the deposit can also be promoted by a liquid flow, which can also be used as another means for removing the deposit. That is, liquid drops are spouted and are not spouted according to a predetermined pattern, whereby the flow quantity of liquid flowing into the ink chamber 9 on the protective film 6 is increased or decreased for each nozzle and removal of the deposit is promoted as the flow changes.

FIGS. 10A to 10E are illustration of liquid jet pattern examples. In the figure, the horizontal direction indicates the nozzle arrangement direction; the head with a nozzle array and a recording medium are moved relatively from top to bottom and liquid is jetted to the portions filled in with black.

Figure 10A:
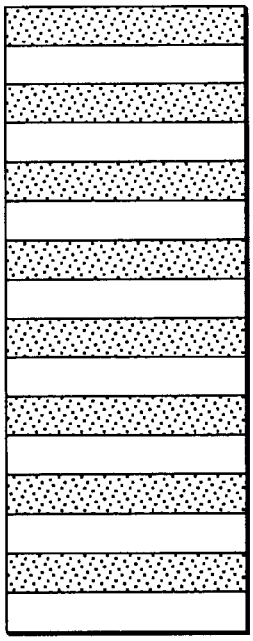
FIGS. 10A to 10E are illustration of liquid jet pattern examples.
Figure 10B:
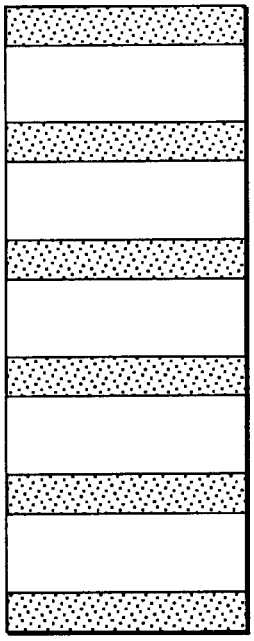
Figure 10C:
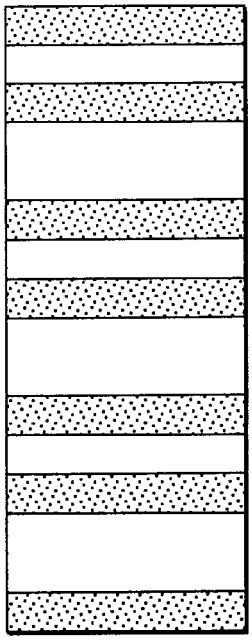
Figure 10D:
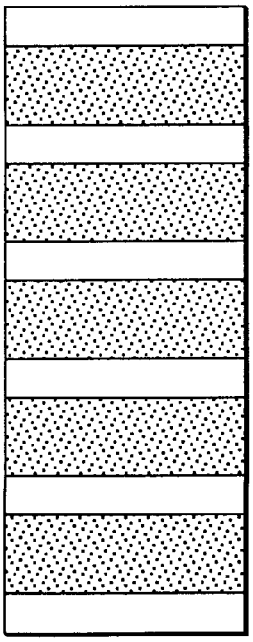
Figure 10E:
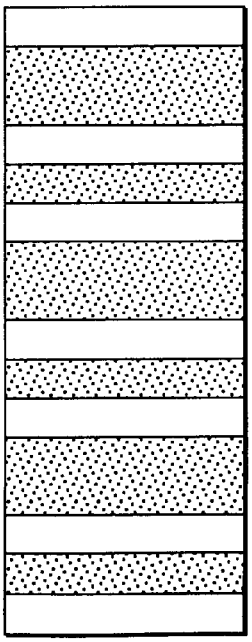

FIG. 10A shows a pattern of jetting a liquid from the nozzles on alternate lines and FIG. 10B shows a pattern of jetting a liquid at intervals of two lines. FIG. 10C shows a pattern provided by mixing the patterns shown in FIG. 10A and (B), namely, an alternating pattern of jetting a liquid on alternate lines and at intervals of two lines. FIG. 10D shows a pattern provided by inverting the spouting and non-spouting pattern shown in FIG. 10B, namely, a pattern of not jetting a liquid at intervals of two lines. FIG. 10E shows a pattern provided by mixing a pattern of not jetting a liquid at intervals of two lines and a pattern of not jetting a liquid on alternate lines.

For example, if the heating resistors 3 are driven so as to jet a liquid on all lines like solid printing, a fierce liquid flow is made on each flow passage, but is a periodic flow and the deposit can be removed only in a given portion on the protective film 6. As shown in FIGS. 10A to 10E, the heating resistors 3 are driven according to the pattern of lines where a liquid is spouted and is not spouted, whereby the liquid flow rapidly weakens on the lines where no liquid is spouted, thus the liquid flow on the protective film 6 changes largely. As the liquid flow changes, peeling of the deposit on the protective film 6 is promoted and the deposit can be removed.

For example, the patterns shown in FIGS. 10A and 10B can also be provided by lowering the drive frequency, but can be provided more easily by controlling spouting and not spouting of a liquid as described above.

We have discussed the deposit removal methods, which can also be used in proper combination; the deposit in the region on the protective film 6 including the heating region can be well removed by the synergistic effect of the combined deposit removal methods.

As seen from the description made so far, according to the invention of aspect 1, when deposit is removed, to maintain a stable jet force, the main pulse width of multi-pulse drive is changed and the main pulse is set to the width wider than the main pulse width starting film boiling in the region on the protective film including the heating regions and narrower than the main pulse width at the normal recording time and a liquid is jetted, whereby the deposit on the protective film can be removed efficiently. Further, as in the invention of aspect 2, after the deposit is removed, dummy jet is executed, whereby the peeled deposit is discharged to the outside and subsequently, good recording operation can be performed. The optimum main pulse width to remove the deposit exists and the optimum value varies depending on the liquid jet state. Thus, as in the invention of aspect 3, the main pulse width is selectively used from within several provided main pulse widths, whereby the optimum value can be selected, for example, in response to the liquid jet state for removing the deposit.

According to the invention of aspect 4, the number of heating resistors for jetting a liquid at the same time is changed and the heating resistors are driven, thereby causing a voltage drop to occur and forming a condition close to the condition under which film boiling starts in the region on the protective film including the heating region, whereby the deposit can be removed by the film boiling as the main pulse width is changed as described above.

Further, according to the invention of aspect 5, the electric energy given to the heating resistors is controlled according to a predetermined pattern comprising a portion where the heating resistors jet a liquid and a portion where the heating resistors do not jet a liquid in proper combination, thereby causing a liquid flow large in strength and weakness to occur in the ink chamber on the protective film, whereby peeling of the deposit adhering on the protective film can be promoted for removing the deposit.

Thus, according to the invention, the deposit on the protective film of the heating resistors can be well removed. Thus, the heat energy produced on the heating resistors can be used efficiently, change in the liquid drop amount is suppressed, and image quality degradation can be prevented for always providing good record images.

What is claimed is:

1. A liquid jet recorder comprising:

nozzles for jetting a liquid, heating resistors being provided in a one-to-one correspondence with said nozzles for receiving electric energy, generating heat energy to jet a liquid, and jetting a liquid from said nozzles, a protective film for protecting said heating resistors, and control means for controlling the electric energy given to said heating resistors, wherein said control means executes multi-pulse drive consisting of prepulses not jetting a liquid to said heating resistors and main pulses jetting a liquid to said heating resistors, sets each main pulse to a width narrower than a main pulse width at normal recording time and wider than a main pulse width starting film boiling in a region on said protective film including heating regions of said heating resistors, and causes said nozzles to jet a liquid for removing deposit adhering onto said protective film.

2. The liquid jet recorder of claim 1, wherein said control means executes dummy jet for jetting a liquid as at the normal recording time after removing the deposit.

3. The liquid jet recorder of claim 1, wherein said control means selectively uses the main pulse width for removing the deposit from within two or more main pulse widths.

4. A liquid jet recorder comprising:

a plurality of nozzles for jetting a liquid, heating resistors being provided in a one-to-one correspondence with said nozzles for receiving electric energy, generating heat energy to jet a liquid, and jetting a liquid from said nozzles, a protective film for protecting said heating resistors, and control means for controlling the electric energy given to said heating resistors, wherein said control means changes the number of said heating resistors for jetting a liquid at the same time, and drives said heating resistors for removing deposit adhering onto said protective film.

5. A liquid jet recorder comprising:

nozzles for jetting a liquid, heating resistors being provided in a one-to-one correspondence with said nozzles for receiving electric energy, generating heat energy to jet a liquid, and jetting a liquid from said nozzles, a protective film for protecting said heating resistors, and control means for controlling the electric energy given to said heating resistors, wherein said control means controls the electric energy given to said heating resistors according to a predetermined pattern comprising a portion where said heating resistors jet a liquid and a portion where said heating resistors do not jet a liquid in proper combination for removing deposit adhering onto said protective film.

* * * * *